US005934038A

United States Patent [19]

Clausen

[11] Patent Number: 5,934,038

[45] Date of Patent: Aug. 10, 1999

[54] METHOD OF PRE-GLAZING A STRUCTURAL FRAME AND WINDOW ASSEMBLY FOR AN OFFICE/COMMERCIAL BUILDING IN A CONTROLLED FACTORY ENVIRONMENT

[76] Inventor: Charles K. Clausen, 7094 Stone Ct., Columbus, Ohio 43235

[21] Appl. No.: 08/839,069

[22] Filed: Apr. 23, 1997

[51] Int. Cl.[6] ..... E04G 21/14; E04F 21/28

[52] U.S. Cl. ..... 52/745.2; 52/747.1; 52/745.16; 52/745.1; 52/143; 52/235; 52/122.1

[58] Field of Search ..... 52/745.19, 745.2, 52/745.16, 745.1, 745.06, 745.05, 747.1, 79.9, 143, 122.1, 235, 204.1, 208, 210, 211

[56] References Cited

U.S. PATENT DOCUMENTS

| | | | |
|---|---|---|---|
| 3,315,426 | 4/1967 | Rolland | 52/235 |
| 4,591,308 | 5/1986 | Imai | 52/745.21 X |
| 4,848,053 | 7/1989 | Clausen | 52/483 X |
| 5,099,623 | 3/1992 | Smith et al. | 52/745.2 X |
| 5,285,606 | 2/1994 | Hagemeyer | 52/745.2 X |

FOREIGN PATENT DOCUMENTS

| | | | |
|---|---|---|---|
| 406073892 | 3/1994 | Japan | 52/122.1 |

*Primary Examiner*—Robert Canfield
*Attorney, Agent, or Firm*—Porter, Wright, Morris & Arthur

[57] ABSTRACT

A unique method of pre-glazing a structural frame and window assembly for an office/commercial building in a controlled factory environment at a remote location from the installation site, transporting the pre-glazed frame and window assembly to the installation site, and installing the pre-glazed frame and window assembly in an opening in the office/commercial building.

10 Claims, 8 Drawing Sheets

METHOD OF PRE-GLAZING A STRUCTURAL FRAME AND WINDOW ASSEMBLY FOR AN OFFICE/COMMERCIAL BUILDING IN A CONTROLLED FACTORY ENVIRONMENT

FIELD OF THE INVENTION

This invention relates to a method of pre-glazing a structural frame and window assembly for an office/commercial building in a controlled factory environment at a remote location from the installation site, transporting the pre-glazed frame and window assembly to the installation site, and installing the pre-glazed frame and window assembly in an opening in the office/commercial building.

BACKGROUND AND SUMMARY OF THE INVENTION

Construction of office/commercial buildings with glazed frame and window assemblies are becoming more common. The construction of these office/commercial buildings with large structural windows is labor intensive, expensive, difficult to maintain high quality control, and potentially dangerous for workers handling large sheets of glass, all of which are affected by adverse weather conditions and adverse conditions at the installation site.

The typical material used for the frames of structural windows in office/commercial buildings is aluminum. Wood is another material that may be used as well as laminated veneer lumber ("LVL"), as shown in U.S. Pat. No. 4,848,053, which has the same inventor as the present invention. U.S. Pat. No. 4,848,053 is incorporated herein by reference. The use of LVL in the frame provides far greater strength than aluminum in supporting the glass in a structural flame and window assembly (especially if the frame and window assembly needs to be lifted and moved).

The present invention relates to "structural" flame and window assemblies which are for large office/commercial buildings and not "residential" type of windows. Residential windows are fairly lightweight and generally can be lifted by one person. The strength of the frame for a residential window is far less critical than the strength of the frame for a structural window that may be installed many stories above the ground where it is subject to high wind forces and wind sheer. A structural window is much larger and heavier (e.g., it may weigh more than 500 pounds). Therefore, the structural frame and window assemblies for office/commercial buildings that are the subject of the present invention are much more difficult to handle and install. The present invention provides a vast improvement over the prior art regarding structural windows for office/commercial buildings.

A typical way to build and install structural frame and window assemblies is to first build the frame in the opening in an office/commercial building at the installation site where the window is to be installed. After the flame is built in the opening, the glass is inserted and secured within the frame and then sealed. This has many drawbacks, including the fact that large, heavy sheets of glass are delivered to the installation site and must be handled manually by workers who are exposed to dangers when breakage occurs. This is complicated by the fact that many installation sites have uneven and/or muddy ground over which the workers must walk while carrying the large, heavy sheets of glass. The workers must bring all of the appropriate tools to the installation site, the workers may need to move the large, heavy sheets of glass up many stories above the ground to install the glass in the frame in the opening of the office/commercial building.

The present invention overcomes the problems in the prior art by providing a method of pre-glazing a structural frame and window assembly in a controlled factory environment at a remote location from the installation site, the frame and window assembly being intended for use in an office/commercial building, transporting the pre-glazed frame and window assembly to the installation site, and installing the pre-glazed frame and window assembly in the office/commercial building at the installation site. The remote location where the structural frame and window assembly is fabricated and glazed is a controlled factory environment, which avoids weather-related problems, installation site problems such as uneven ground and mud, the need for workers to have all tools at the installation site in order to build the frame and install the glass in the frame, wasted time of workers travelling to and from the installation site and waiting for materials and/or equipment to arrive, and avoids some of the dangers with dealing with large, heavy sheets of glass that are not in frames. Pre-glazing the frame and window assembly in a controlled factory environment enables higher quality control than would be possible on installation sites for a number of reasons including the effects of cold weather when sealing the frame and window assembly, supervisors can more easily check the work of others without going out to the installation site to do so. Furthermore, all of the sheets of glass can be delivered to the controlled factory environment where the pre-glazed structural frame and window assemblies are fabricated, thereby decreasing the amount of broken glass that occurs on installation sites.

Various objects and advantages of the present invention will become apparent from the following detailed description when viewed in conjunction with the accompanying drawings, which set forth certain embodiments of the invention.

DESCRIPTION OF PREFERRED EMBODIMENTS

Figure 1:
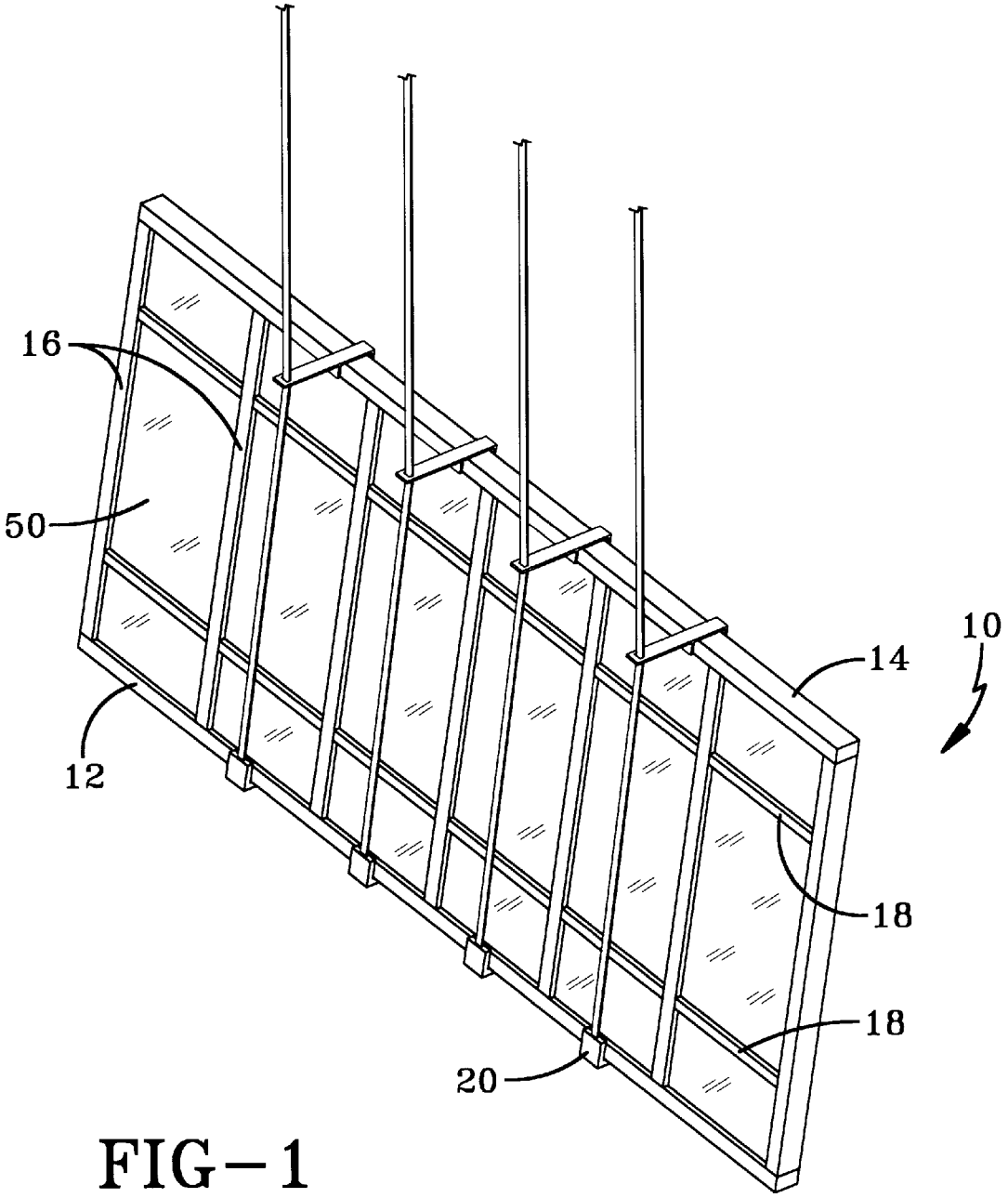
FIG. 1 shows a pre-glazed structural frame and window assembly being lifted by clips in accordance with the present invention.
Figure 2:
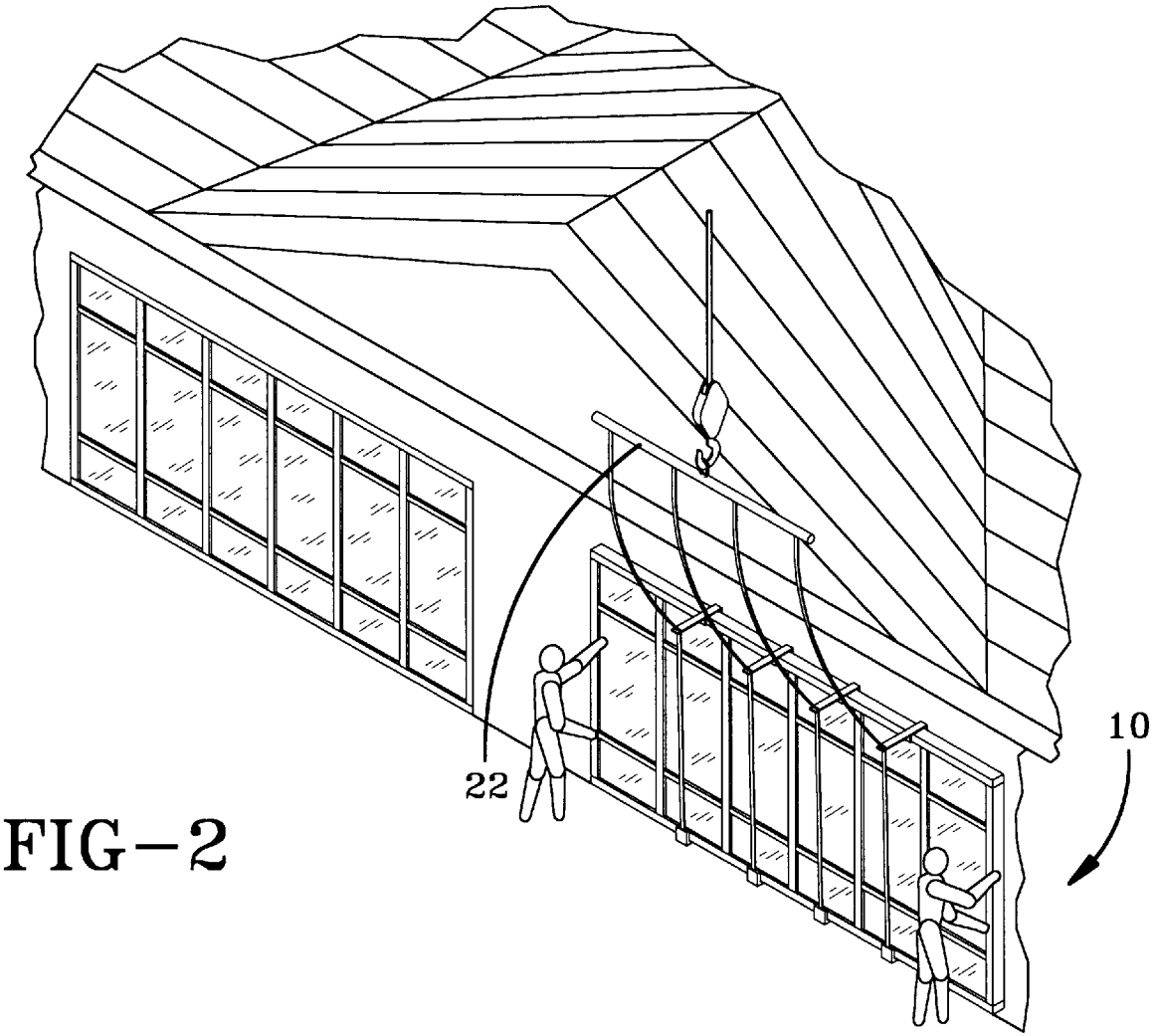
FIGS. 2 and 3 show a pre-glazed structural frame and window assembly being installed in the opening in a building in accordance with the present invention.
Figure 3:
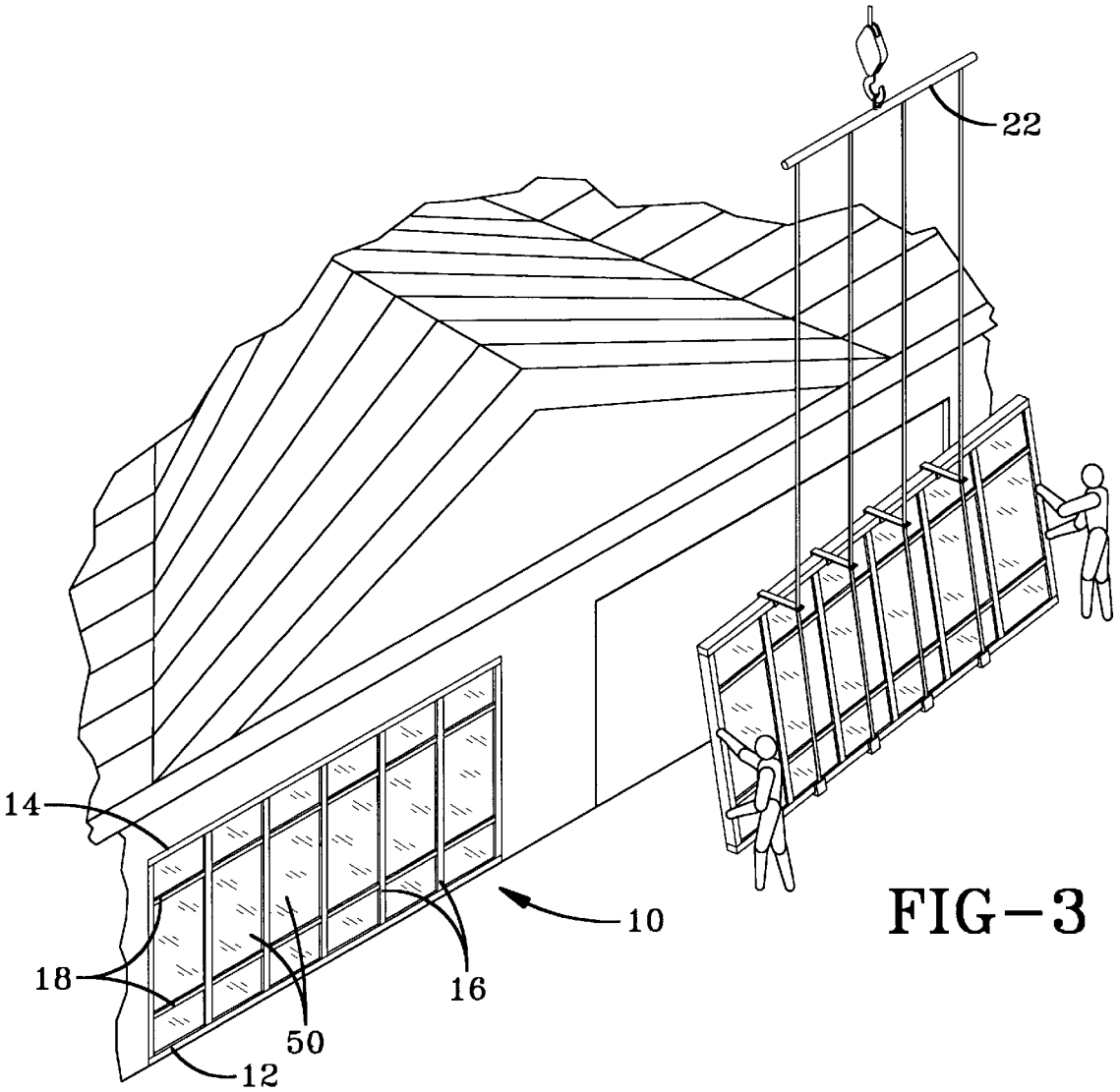
Figure 4:
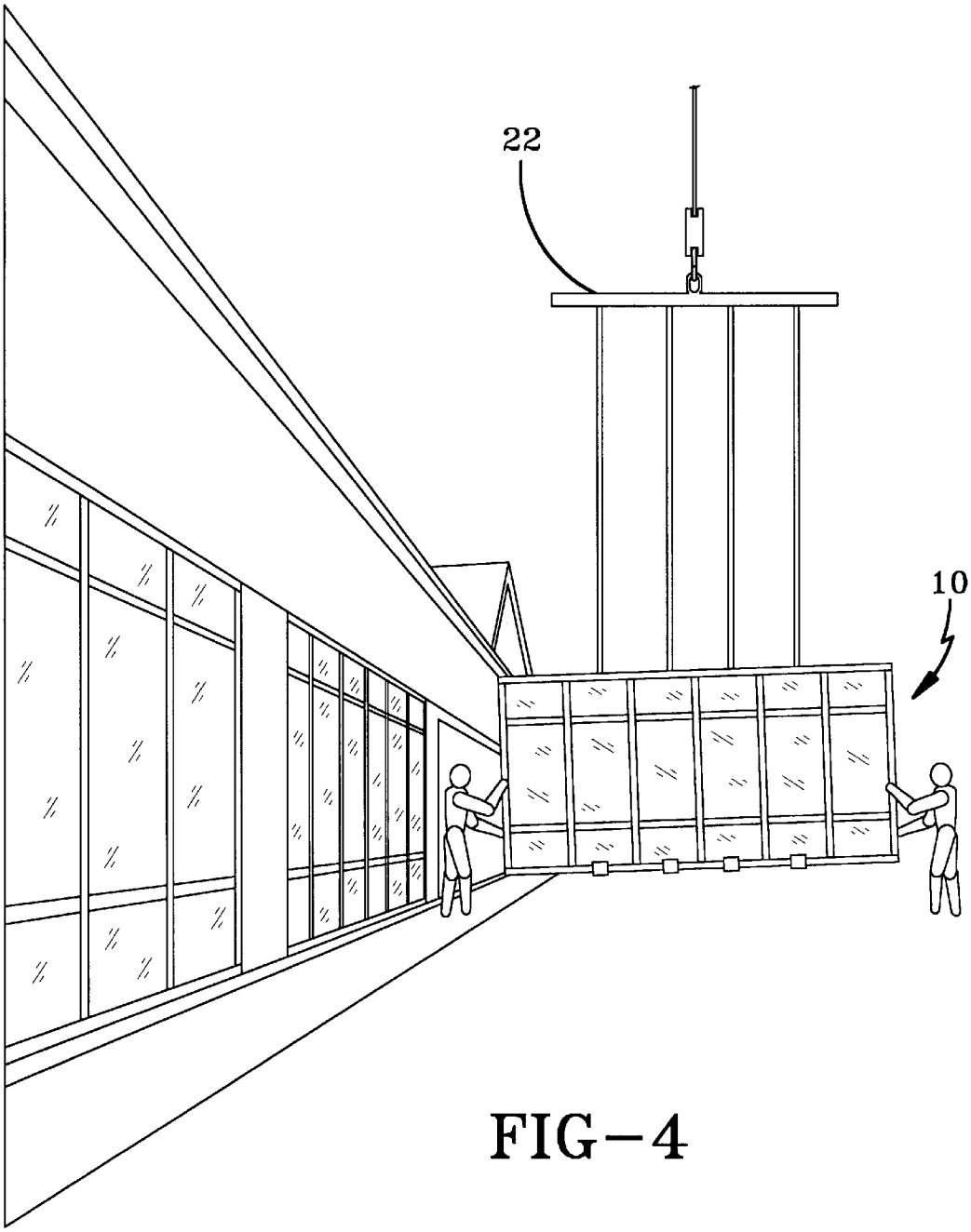
FIG. 4 shows a pre-glazed structural frame and window assembly being lifted by clips in accordance with the present invention.
Figure 5:
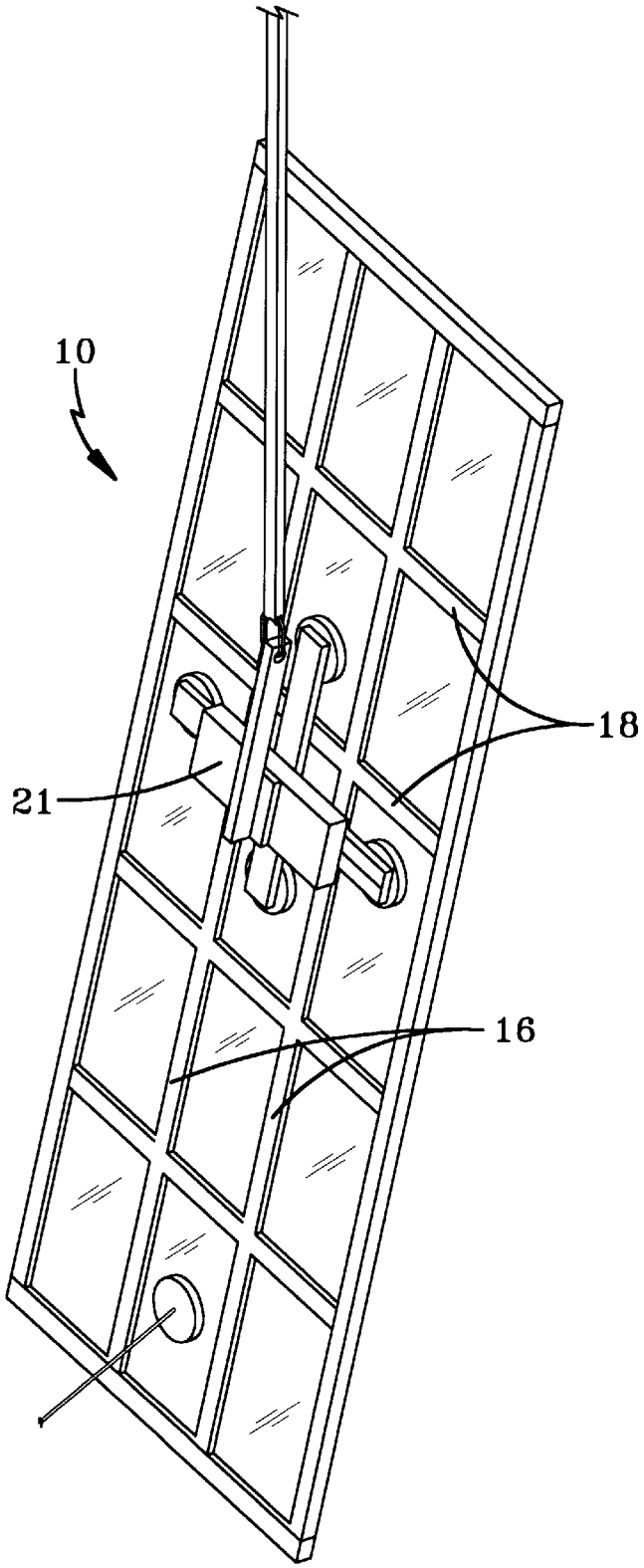
FIGS. 5, 6 and 7 show a pre-glazed structural frame and window assembly being lifted and installed using a vacuum suction cup device in accordance with the present invention.
Figure 6:
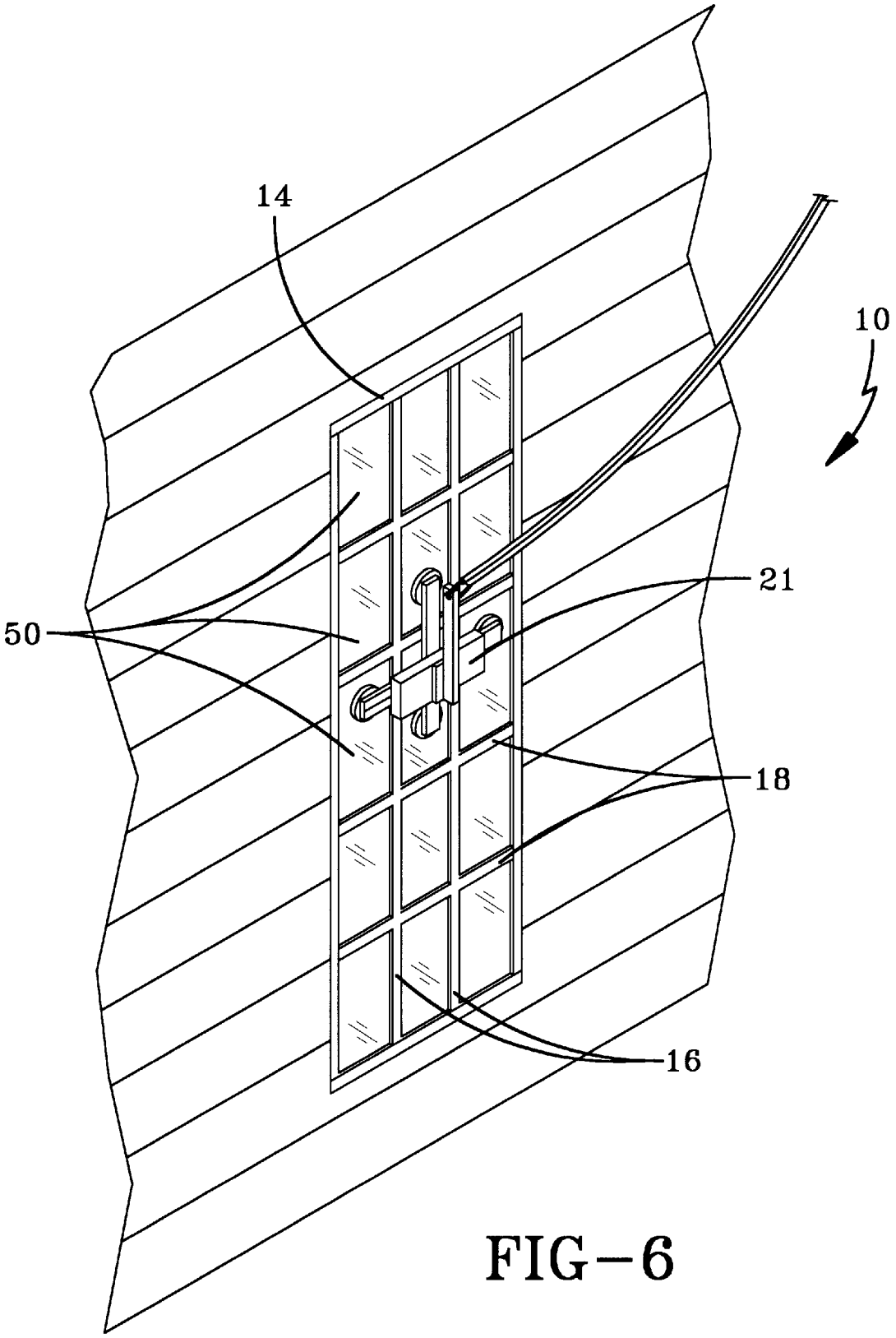
Figure 7:
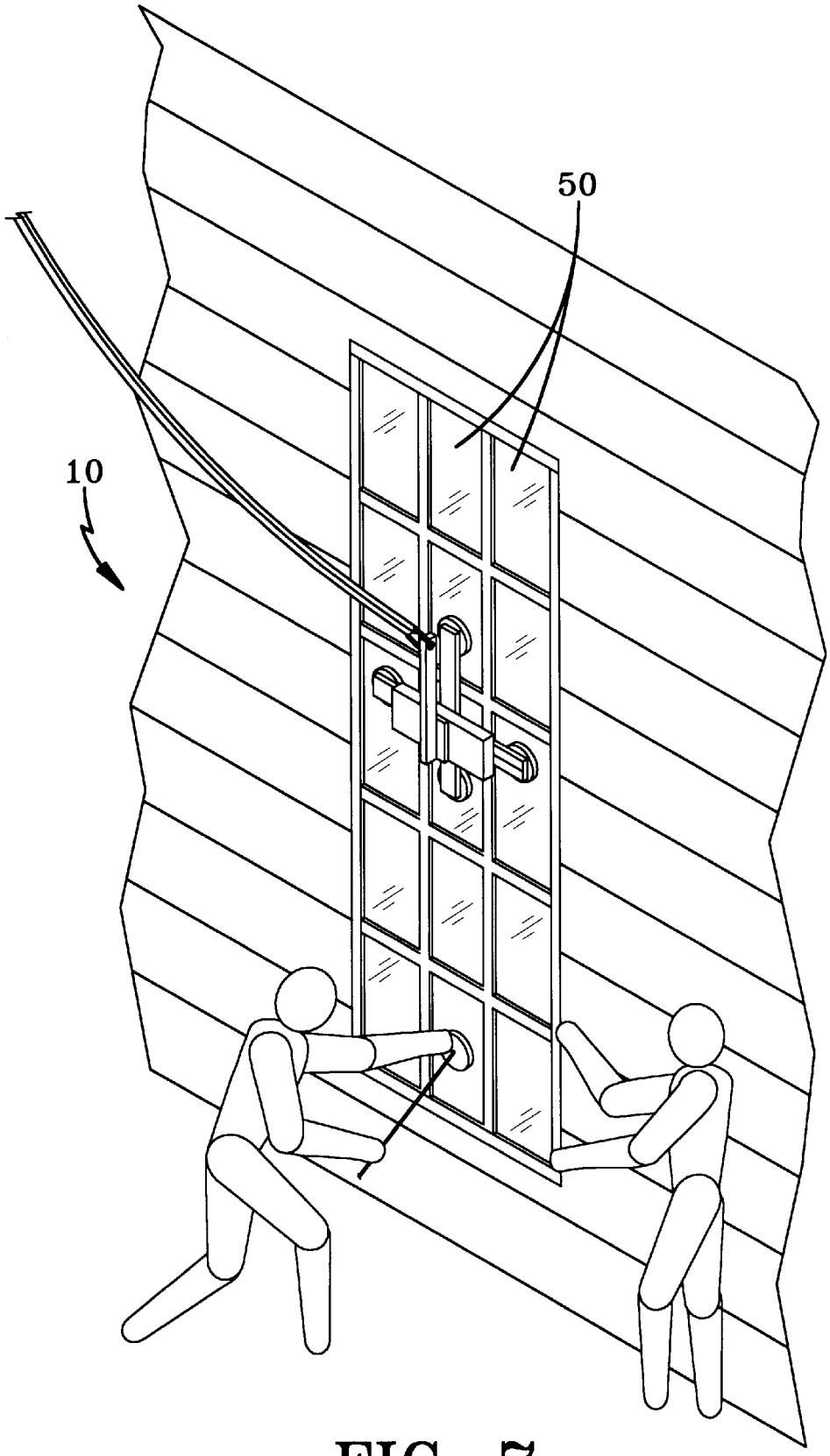
Figure 8:
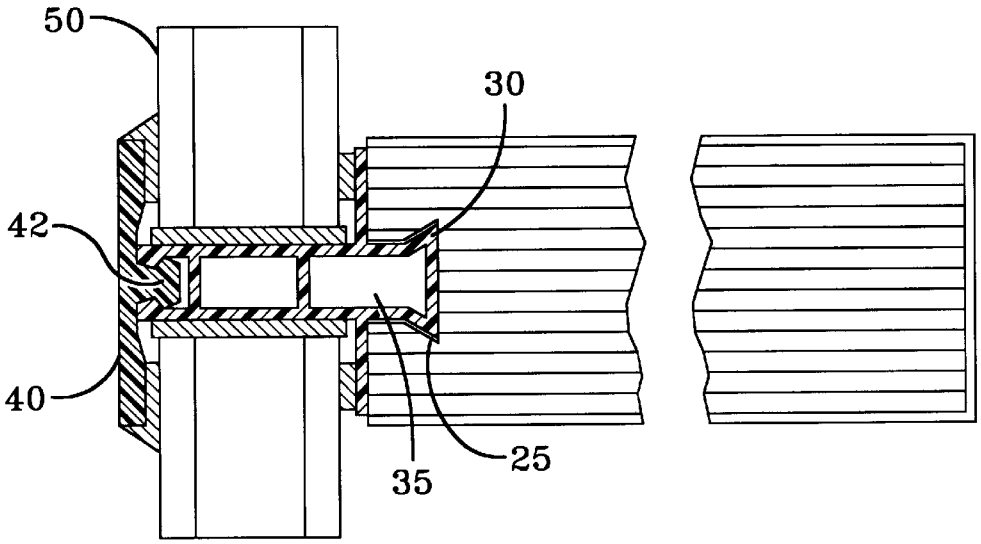
FIGS. 8 and 9 show a side view of a pre-glazed structural frame and window assembly in accordance with the present invention.
Figure 9:
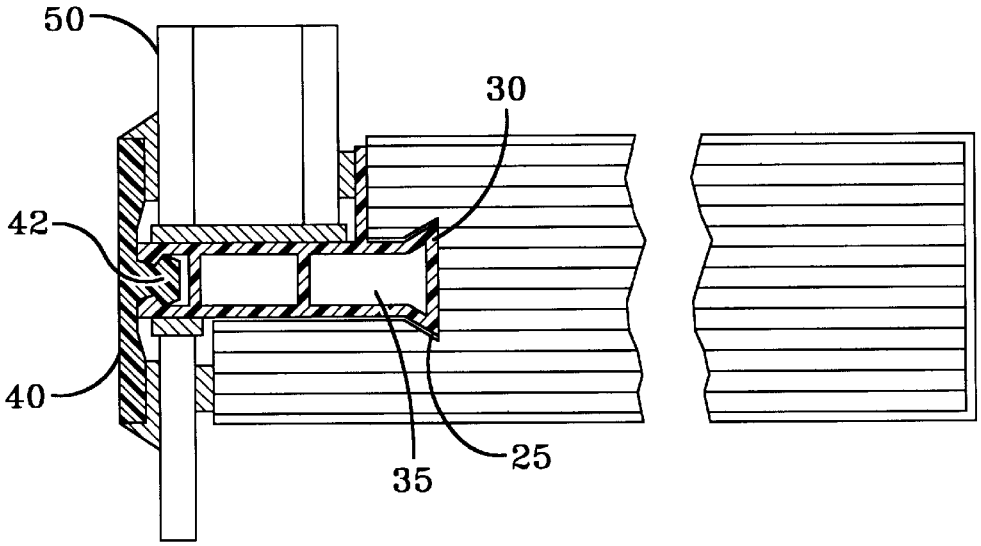

A pre-glazed structural frame and window assembly 10 of the present invention is shown in FIGS. 1–9. The structural frame and window assembly 10 is preferably made of LVL to provide enhanced strength and support for the entire assembly 10. The use of LVL enables the completed pre-glazed structural frame and window assembly 10 to be lifted without having the frame or the glass break or deform, thereby enabling the structural frame and window assembly 10 to be transported and installed in an opening of a office/commercial building at the installation site.

The pre-glazed structural frame and window assembly preferably has a bottom plate 12 and a top plate 14. The bottom plate 12 and top plate 14 may be made of 2" by 4" boards made of LVL or other suitably sized boards or beams. The structural frame and window assembly 10 also includes vertical members 16 (preferably made of LVL) connected to and extending from the top plate 14 to the bottom plate 12. Where the vertical members 16 meet with the top plate 14 and bottom plate 12, they are attached by large screws or other fasteners to securely attach these members together. The pre-glazed structural frame and window assembly 10 also typically includes horizontal members 18 connected to and extending between the vertical members 16 and secured by screws or other fasteners to attach these members together.

The glazing of the structural frame and window assembly 10 generally consists of installing the glass between the top plate 14, the bottom plate 12, the horizontal members 18 and the vertical members 16, and then sealing the joints where the glass joins the frame. The method of pre-glazing a structural frame and window assembly 10 in a controlled factory environment in accordance with the present invention preferably includes the steps of (1) assembling a rigid frame having a top plate 14, a bottom plate 12, a plurality of vertical members 16, and a plurality of horizontal members 18, with the vertical members 16 being connected to and extending between the top plate 14 and the bottom plate 12, said horizontal members 18 being connected to and extending between the vertical members 16, and said top plate 14, bottom plate 12, vertical members 16, and horizontal members 18 having channels 25 formed therein that extend along the length of the top plate 14, bottom plate 12, vertical members 16, and horizontal members 18; (2) securing layers of vinyl 30 in the channels 25 in the top plate 14, bottom plate 12, vertical members 16, and horizontal members 18, the layers of vinyl 30 extending along the length of the top plate 14, bottom plate 12, vertical members 16, and horizontal members 18, said layers of vinyl 30 having channels 35 formed therein that extend along the length of the layers of vinyl 30; (3) providing elongated cap members 40 having a substantially "T" cross-sectional shape, and inserting and locking the protruding base portion 42 of the "T" into the channels 35 formed in the vinyl layers 30, said cap members 40 extending along the length of the channels 35 in the layers of vinyl; (4) inserting sheets of glass 50 between the top plate 14, bottom plate 12, vertical members 16, and horizontal members 18 with the edges of the sheets of glass 50 inserted between the cap members 40 and the layers of vinyl 30 to firmly hold the sheets of glass 50 in place; and (5) sealing the joints where the cap members 40 and layers of vinyl 30 join the sheets of glass 50.

The completed glazed structural frame and window assembly 10 is then typically loaded onto a flatbed truck and transported from the remote controlled factory environment location to the installation site. At the installation site, attachment means such as lifting clips 20 or a vacuum suction cup device 21 is attached to the pre-glazed structural frame and window assembly 10. If the lifting clips 20 are used, cables are connected to the lifting clips 20 and the cables are either connected directly to a crane or to a spreader bar 22 which is connected to a crane or other device used for lifting heavy objects. The pre-glazed structural frame and window assembly 10 can then be lifted by a crane via the lifting clips 20 and, due to the strong construction of the pre-glazed structural frame and window assembly 10 (using LVL and the other components discussed herein), the torque from the lifting clips to the structural frame and window assembly 10 does not break the frame or the glass 50, and therefore the complete pre-glazed structural frame and window assembly 10 can be lifted off of the flatbed truck and moved to the opening in the office/commercial building at the installation site. The workers then fit the complete pre-glazed structural frame and window assembly 10 into the opening and attach the pre-glazed structural frame and window assembly 10 to the walls surrounding the opening in the office/commercial building.

This saves a tremendous amount of time and money because the work necessary to install the completed pre-glazed structural frame and window assembly 10 into the opening in the office/commercial building is small in comparison to the time it takes to fabricate and glaze the frame and window assembly 10 at the installation site. This also allows the sheets of glass 50 to be delivered to the controlled factory environment instead of being delivered to the installation site where there is a higher risk of breakage.

Another advantage of the present invention is that the pre-glazed structural frame and window assembly 10 can be installed into the opening in the office/commercial building at an early stage of construction after the steel framing of the office/commercial building is completed. At the present time, these type of structural frame and window assemblies are typically installed when the building is closer to being completed (after the brick or block on the exterior of the building has been installed), and then the glazed structural frame and window assemblies must installed into the opening that exists at that time. The present invention provides an advantage in that the pre-glazed structural frame and window assembly 10 can be installed early in the construction process before the carpenters and bricklayers build their portion of the building, which enables the carpenters and bricklayers to build walls around and up next to the pre-glazed structural frame and window assembly 10.

Another embodiment of the attachment means (besides the lifting clips 20) is a vacuum suction cup device 21 that attaches to the glass sheets 50 within the pre-glazed structural frame and window assembly 10. This enable a crane to pick up the pre-glazed structural frame and window assembly 10 and move the assembly 10 to the opening in the office/commercial building. These suction cup devices pose more risk at the installation site than the lifting clips 20 because if one of the sheets of glass 50 cracks or breaks, the entire pre-glazed structural frame and window assembly 10 can fall and workers will be exposed to potential harm. The use of the lifting clips 20 is much safer because it is does not depend upon the integrity of the sheets of glass 50 as the only support to lift up and move the entire frame and window assembly 10. The lifting clips 20 do exert a fair amount of torque onto the frame of the pre-glazed structural frame and window assembly 10, but the use of LVL and the other components in the present invention provides enough strength that the pre-glazed structural frame and window assembly 10 remains intact without warpage or breakage of the frame or glass 50.

Having described the invention in detail, those skilled in the art will appreciate that, given the present disclosure, modifications may be made to the invention without departing from the spirit of the inventive concept herein described. Therefore, it is not intended that the scope of the invention be limited to the specific and preferred embodiments illustrated and described. Rather, it is intended that the scope of the invention be determined by the abated claims.

What is claimed is:

1. A method of pre-glazing a structural frame and window assembly in a controlled factory environment at a remote location from the installation site, the frame and window assembly being intended for use in an office/commercial building, transporting the pre-glazed frame and window assembly to the installation site, and installing the pre-glazed frame and window assembly in the office/commercial building at the installation site, said method comprising the steps of:

assembling a rigid frame having a top plate, a bottom plate, and a plurality of vertical members connected to and extending between the top plate and the bottom plate, the top plate, bottom plate, and vertical members having channels formed therein that extend along the length of the top plate, bottom plate, and vertical members;

securing layers of vinyl in the channels in the top plate, bottom plate, and vertical members, said layers of vinyl extending along the length of the top plate, bottom plate, and vertical members, said layers of vinyl having channels formed therein that extend along the length of the layers of vinyl;

providing elongated cap members having a substantially "T" cross-sectional shape, and inserting and locking the protruding base portion of the "T" into the channels formed in the vinyl layers, said cap members extending along the length of the channels in the layers of vinyl;

inserting sheets of glass between the top plate, bottom plate, and vertical members with the edges of the sheets of glass inserted between the cap members and the layers of vinyl to firmly hold the sheets of glass in place;

sealing the joints where the cap members and layers of vinyl join the sheets of glass;

transporting the glazed structural frame and window assembly from the remote site to the installation site;

providing attachment means with respect to the frame and window assembly whereby the assembly can be positioned with respect to an opening in the office/commercial building for installation therein;

utilizing the attachment means to position the frame and window assembly in the opening; and installing the glazed structural frame and window assembly in the opening.

2. The method of claim 1 herein the top plate, bottom plate, and vertical members are made of laminated veneer lumber.

3. The method of claim 1 wherein the attachment means consists of lifting clips used to lift the glazed structural frame and window assembly.

4. The method of claim 1 wherein the attachment means is a vacuum suction cup device used to lift the glazed structural frame and window assembly.

5. A method of pre-glazing a structural frame and window assembly in a controlled factory environment at a remote location from the installation site, the frame and window assembly being intended for use in an office/commercial building, transporting the pre-glazed frame and window assembly to the installation site, and installing the pre-glazed frame and window assembly in the office/commercial building at the installation site, said method comprising the steps of:

assembling a rigid frame having a top plate, a bottom plate, a plurality of vertical members, and a plurality of horizontal members, said vertical members being connected to and extending between the top plate and the bottom plate, said horizontal members being connected to and extending between the vertical members, and said top plate, bottom plate, vertical members, and horizontal members having channels formed therein that extend along the length of the top plate, bottom plate, vertical members, and horizontal members;

securing layers of vinyl in the channels in the top plate, bottom plate, vertical members, and horizontal members, said layers of vinyl extending along the length of the top plate, bottom plate, vertical members, and horizontal members, said layers of vinyl having channels formed therein that extend along the length of the layers of vinyl;

providing elongated cap members having a substantially "T" cross-sectional shape, and inserting and locking the protruding base portion of the "T" into the channels formed in the vinyl layers, said cap members extending along the length of the channels in the layers of vinyl;

inserting sheets of glass between the top plate, bottom plate, vertical members, and horizontal members with the edges of the sheets of glass inserted between the cap members and the layers of vinyl to firmly hold the sheets of glass in place;

sealing the joints where the cap members and layers of vinyl join the sheets of glass;

transporting the glazed structural frame and window assembly from the remote site to the installation site;

providing attachment means with respect to the frame and window assembly whereby the assembly can be positioned with respect to an opening in the office/commercial building for installation therein;

utilizing the attachment means to position the frame and window assembly in the opening; and installing the glazed structural frame and window assembly in the opening.

6. The method of claim 5 wherein the top plate, bottom plate, vertical members and horizontal members are made of laminated veneer lumber.

7. The method of claim 5 wherein the attachment means consists of lifting clips used to lift the glazed structural frame and window assembly.

8. The method of claim 5 wherein the attachment means is a vacuum suction cup device used to lift the glazed structural frame and window assembly.

9. A method of pre-glazing a structural frame and window assembly in a controlled factory environment at a remote location from the installation site, the frame and window assembly being intended for use in an office/commercial building, transporting the pre-glazed frame and window assembly to the installation site, and installing the pre-glazed frame and window assembly in the office/commercial building at the installation site, said method comprising the steps of:

assembling a rigid frame having a top plate, a bottom plate, and a plurality of vertical members connected to and extending between the top plate and the bottom plate, the top plate, bottom plate, and vertical members having channels formed therein that extend along the length of the top plate, bottom plate, and vertical members;

securing elongated cap members having a substantially "T" cross-sectional shape into channels in said top plate, bottom plate and plurality of vertical members by locking the protruding base portion of the "T" into the channels , said channels having vinyl layers between said channels and said protruding base portion of the "T", said cap members extending along the length of the channels in the layers of vinyl;

inserting sheets of glass between the top plate, bottom plate, and vertical members with the edges of the sheets of glass inserted between the cap members and the top plate, bottom plate, and plurality of vertical members to firmly hold the sheets of glass in place;

sealing the joints where the cap members and top plate, bottom plate, and plurality of vertical members join the sheets of glass;

transporting the glazed structural frame and window assembly from the remote site to the installation site;

providing attachment means with respect to the frame and window assembly whereby the assembly can be positioned with respect to an opening in the office/commercial building for installation therein;

utilizing the attachment means to position the frame and window assembly in the opening; and installing the glazed structural frame and window assembly in the opening.

10. The method of claim 9 wherein the step of assembling a rigid frame further comprises assembling a plurality o horizontal members having channels formed therein that extend along the length of the horizontal members.

* * * * *